US005473987A

United States Patent [19]

Beck

[11] Patent Number: 5,473,987

[45] Date of Patent: Dec. 12, 1995

[54] LOW ENERGY FUSE

[75] Inventor: Michael W. Beck, Edenvale, South Africa

[73] Assignee: Imperial Chemical Industries PLC, London, England

[21] Appl. No.: 425,235

[22] Filed: Apr. 18, 1995

Related U.S. Application Data

[63] Continuation of Ser. No. 117,647, Sep. 8, 1993, abandoned, which is a continuation of Ser. No. 744,519, Aug. 13, 1991, abandoned.

[30] Foreign Application Priority Data

Aug. 13, 1990 [GB] United Kingdom ..... 90177163

[51] Int. Cl.[6] ..... C06C 5/04

[52] U.S. Cl. ..... 102/275.8; 102/275.1; 149/78

[58] Field of Search ..... 102/275.1, 275.8, 102/275.11, 275.5, 275.6; 149/38, 78

[56] References Cited

U.S. PATENT DOCUMENTS

| | | | |
|---|---|---|---|
| 2,729,618 | 1/1956 | Muller et al. | 528/48 |
| 2,871,218 | 1/1959 | Schollenberger | 156/331.7 |
| 2,929,801 | 3/1960 | Koller | 528/335 |
| 2,929,802 | 3/1960 | Katz | 528/372 |
| 2,974,596 | 3/1961 | Allen | 149/38 |
| 3,000,757 | 9/1961 | Johnston et al. | 428/272 |
| 3,012,992 | 12/1961 | Pigott et al. | 528/79 |
| 3,100,721 | 8/1963 | Holden | 427/246 |
| 3,311,056 | 3/1967 | Noddin | 102/275.8 |
| 3,590,739 | 7/1971 | Persson | 102/275.7 |
| 3,617,405 | 11/1971 | Stevenson | 149/38 |
| 3,683,742 | 8/1972 | Rohde et al. | 102/275.1 |
| 3,712,222 | 1/1973 | Richardson et al. | 102/275.1 |
| 3,878,785 | 4/1975 | Lundborg | 102/275.4 |
| 4,080,902 | 3/1978 | Goddard et al. | 102/275.8 |
| 4,220,087 | 9/1980 | Posson | 102/275.6 |
| 4,232,606 | 11/1980 | Yunan | 102/275.8 |
| 4,361,450 | 11/1982 | Munson | 149/38 |
| 4,815,382 | 3/1989 | Yunan | 102/275.7 |

FOREIGN PATENT DOCUMENTS

| | | | |
|---|---|---|---|
| 628844 | 8/1963 | Belgium | 149/38 |
| 327219 | 8/1989 | European Pat. Off. . | |
| 3105060 | 9/1982 | Germany | 149/38 |

*Primary Examiner*—Stephen M. Johnson
*Attorney, Agent, or Firm*—Cushman Darby & Cushman

[57] ABSTRACT

A non-electric low energy fuse comprises plastics tubing within which there is provided a core loading of mixed particles of a metal or quasi metal fuel and a secondary high explosive, wherein the core loading additionally contains up to 50% (w/w with respect to the total weight of the core loading) of a particulate solid oxygen-releasing agent effective to enhance the oil resistance of the fuse.

9 Claims, No Drawings

LOW ENERGY FUSE

This is a continuation of application Ser. No. 08/117,647, filed on Sept. 8, 1993, which was abandoned upon the filing hereof which is a continuation of application Ser. No. 07/744,519, filed Aug. 13, 1991, now abandoned.

This invention relates to non-electric low-energy fuses, that is to say, transmission devices in the form of elongate plastics tubing housing reactive or detonable particulate substances at a core loading sufficiently low for there to be no cross-initiation of a similar tube placed alongside (or lateral direct initiation of a surrounding commercial emulsion blasting explosive) when such a device is fired. Ordinarily the core material detonates but in some types rapid deflagration or pyrotechnic reaction suffices as when the tubing is connected to a detonator within which a deflagration to detonation transaction occurs. The signal transmission tubing is itself initiated by an electric cap, a non-electric detonator, an electric discharge device or indeed by any other means capable of initiating the required self-sustaining reaction or detonation of the core material. A favoured type of low energy fuse is the so-called shock tube or signal tube as described in, and cross-referenced in, European Patent Specification No 327219 (ICI). Another distinct class of low-energy fuse is that described in US Patent Specification No 4290366 (Atlas Powder Company). The contents of these prior Specifications and their references are incorporated by reference herein, in their entirety.

The mining, quarrying and construction industries who are the principal users of commercial explosives and accessories and are continually extending the frontiers of their operations into new situations that challenge the reliability of current accessories. Of present relevance is the trend towards increasing use of emulsion explosives and ANFO and heavy ANFO blasting agents, the deployment of non-electric low-energy fuse initiation down-hole as well as on the surface as inter-hole link-ups, coupled with long sleep times (that is the periods of time when the fuse is in contact with the explosive before firing). Commonly the hydrocarbon fuel phase of such explosives is an oil or a petroleum fraction such as diesel, and invariably the plastics from which transmission tubes have been formed have been wholly or mainly of polyethylene (e.g. LLDPE) or a related (co)polymer in which the back-bone chain is a polyethylene and the chain carries side substituents which may be hydrocarbyl or functional groups such as carboxyl and its salt and ester derivatives (e.g. 'Surlyns'). All such polymers are prone to ingress of hydrocarbons of the explosive's fuel oil phase when in prolonged contact therewith. This is so to a greater or lesser extent depending upon the nature of those hydrocarbons, the chemical and physical structure of the polymer of the transmission tubing, and the temperature of the fuel phase (as when an emulsion explosive is loaded hot). Even surface transmission tubing may be in prolonged contact with oil where there is spillage of emulsion explosive or engine oils, and this too may become hot in many of the inhospitable environments in which blasting operations take place.

The Applicants have contrived mis-fires of non-electric transmission devices of the types above-described attributable to penetration of deleterious amounts of hydrocarbons into the interior core of the transmission tubing after prolonged contact.

This invention provides an improved plastics transmission tubing for use as a low-energy fuse wherein the plastics material is equivalent to the currently used plastics which are susceptible to oil penetration over an extended period of time of being in contact therewith e.g. wholly or predominantly made from addition polymers such as a polyolefine or derivatised polyolefine of the kinds hereinbefore described or another oil absorbing plastics material e.g a condensation polymer such as polyamide or polyester, and which contains in its central core a detonable signal transmitting particulate material (such as loose, consolidated, bound and/or thread/filament carried material) comprising a metal or quasi metal fuel and secondary high explosive, and wherein the detonable signal transmitting particulate material has added to it up to about 50% w/w, preferably from 25 to 45% w/w, of a particulate solid oxygen-releasing agent effective to enhance the oil resistance of the fuse.

The percentage weight is expressed with respect to the total weight of the core loading wherein the proportion of metal/quasi metal may suitably be up to 10% of the combined weight of such fuel and high explosive.

A characteristic feature of the present invention is the addition of an amount of oxygen-releasing agent, which is not required for propagation of the initiation signal, for the purpose of mitigating the effect of ingressed fuel. This has been shown to be capable of giving a substantially extended operational life of transmission tube.

In a second aspect of the invention there is provided a method of extending the operational life of a transmission tubing for use as a low energy fuse which will be in contact with hot fuel oil such as diesel, the method comprising forming a transmission tubing of which the plastics material is wholly or predominantly a polyolefine or a derivatised polyolefine of the kinds above described (but may also be another oil absorbing plastic such as polyamide or polyester) and which contains in its central core a reactive signal transmitting particulate substance (such as loose, consolidated, bound or thread/filament carried material), comprising a metal or quasi metal fuel and secondary high explosive, wherein during forming of the tubing up to about 50% w/w, say about 25% to 45% w/w, of a particulate solid oxygen-releasing agent is also added into the central core of the tubing to enhance the oil resistance of the fuse.

A third aspect of the invention provides a method of detonating a low energy fuse comprising bringing a low energy fuse as defined in the first aspect of the invention into contact with a fuel component of an emulsion explosive to be detonated, leaving the fuse in for at least 70 hours, and detonating the low energy fuse to initiate an explosion.

Oxygen releasing agents are known for use as principal reagents of pyrotechnic mixtures in the art of low-energy fuses (e.g. see referenced publications in European Patent Specification no. 327219), and include compounds such as perchlorates, permanganates and peroxides.

Suitable secondary high explosives include one or more of the following: PETN, RDX, HMX, TNT, dinitroethylurea and tetryl.

Suitable metal/quasi metal fuels are already known in the art as such e.g. aluminium and silicon.

In an example of the invention, a polyethylene transmission tube was constructed as follows.

A blend of LLDPE (85%) and low functionality (2%) EVA (15%) was extruded by a Battenfelder extruder (5.0 cm diameter, 24:11/d metering screw), through a 3.0 cm outer die and a 1.4 cm inner mandrel. The melt was subjected to a 15:1 drawdown over 25 cm through a 7.6 mm diameter sizing die and processed as known per se in the art. The large tube dimensions were about 7.6 mm outer diameter (O.D.) extruded at a rate of about 5 m per minute. After stretching, the tube size was about 3 mm O.D. and produced at a rate of 45 m per minute. A reactive/detonable core mixture of 6 parts aluminium and 94 parts HMX to which 54 parts of $KClO_4$ were added (i.e. respectively about 3.9% w/w, 61.04% w/w and 35.06% w/w) to the large tube at a rate sufficient to give a final core load of about 20 mg/m (4.4 $g/m^2$ of internal area). The tensile strength of this tube was about 140 $N/m^2$.

A break load of 80 kg was required at an extension of 160%.

After immersing the tube in diesel at 50° C. for 150 hours, the fuse was detonated successfully. The time in which the fuse consistently failed was very much later than a corresponding fuse which lacked the presence of $KClO_4$ (below 80 hours)

It will be appreciated that the core loading will be variable depending on the sleep time field conditions, and strength required. Preliminary tests suggest, however, that a core loading of from about 15 to 25 $mgm^{-1}$ will be suitable for an oil resistant shock tube.

Of course the temperature (and therefore penetration) of the fuel used in the field will vary considerably (from say 25° C. to 70° C.) and therefore this should be borne in mind when constructing a low energy fuse of the invention which must have a specified minimum sleep time.

The invention also extends to low-energy fuse assemblies comprising delay elements and/or detonators connected to one or both ends of the transmission tubing as aforesaid.

What is claimed is:

1. In a non-electric low energy fuse for use in blasting operations where hot oil is in contact with said fuse for prolonged periods of time, said fuse being formed from plastics tubing consisting essentially of addition polymer, in which there is provided a core loading of mixed particles in an amount of about 15 to about 25 mg per meter of tubing, said core-loading comprising a secondary high explosive selected from the group consisting of PETN, RDX, HMX, TNT, dinitroethylurea and tetryl and a fuel selected from the group consisting of metals and quasi metals, the improvement wherein said core loading additionally contains from about 25% up to about 50% by weight, based on a total weight of said core loading, of a particulate solid oxygen-releasing agent selected from the group consisting of perchlorates, permanganates and peroxides, said oxygen-releasing agent being effective to enhance oil resistance to said fuse.

2. The non-electric low energy fuse of claim 1 wherein the additional content of oxygen-releasing agent is from about 25 to about 45% by weight based on the total weight of the core loading.

3. The non-electric low energy fuse of claim 1 wherein a proportion of said fuel is up to about 10% of a combined weight of said fuel and said secondary high explosive.

4. The non-electric low energy fuse of claim 1 wherein said plastics tubing comprises a polymer selected from the group consisting of polyolefines, branched polyolefines, polyolefines having functional group side substituents, derivatives thereof, and copolymers thereof.

5. The non-electric low energy fuse of claim 1 wherein the metal fuel is aluminum and the quasi metal is silicon.

6. The non-electric low energy fuse of claim 1 wherein the form of the core loading is selected from the group consisting of loose packing, consolidated packing, bound and thread/filament carried material.

7. A low energy fuse according to claim 1 wherein the oxygen-releasing agent is a perchlorate.

8. A low energy fuse according to claim 7 wherein the oxygen-releasing agent is $KClO_4$.

9. A non-electric low energy fuse formed from a polyethylene tube in which there is provided a reactive/detonable core mixture of 6 parts aluminum and 94 parts HMX and a further 54 parts of $KClO_4$ as a final core loading of 20 mg $m^{-1}$ of said tube.

* * * * *